US008140296B2

(12) United States Patent
Francino et al.

(10) Patent No.: US 8,140,296 B2
(45) Date of Patent: Mar. 20, 2012

(54) METHOD AND APPARATUS FOR GENERALIZED PERFORMANCE EVALUATION OF EQUIPMENT USING ACHIEVABLE PERFORMANCE DERIVED FROM STATISTICS AND REAL-TIME DATA

(75) Inventors: Peter N. Francino, Renfrew, PA (US); Xu Cheng, Pittsburgh, PA (US); Frederick C. Huff, Pittsburgh, PA (US)

(73) Assignee: Emerson Process Management Power & Water Solutions, Inc., Pittsburgh, PA (US)

( * ) Notice: Subject to any disclaimer, the term of this patent is extended or adjusted under 35 U.S.C. 154(b) by 311 days.

(21) Appl. No.: 12/047,139

(22) Filed: Mar. 12, 2008

(65) Prior Publication Data

US 2008/0288198 A1 Nov. 20, 2008

Related U.S. Application Data

(63) Continuation-in-part of application No. 11/146,170, filed on Jun. 6, 2005, now Pat. No. 7,383,790.

(60) Provisional application No. 60/894,339, filed on Mar. 12, 2007.

(51) Int. Cl.
*G06F 11/30* (2006.01)

(52) U.S. Cl. ..... 702/182

(58) Field of Classification Search ..... 702/182
See application file for complete search history.

(56) References Cited

U.S. PATENT DOCUMENTS 3,137,278 A * 6/1964 Cantieri et al. ..... 122/392
4,085,438 A * 4/1978 Butler ..... 364/107
5,181,482 A * 1/1993 Labbe et al. ..... 122/392
5,440,478 A * 8/1995 Fisher et al. ..... 364/188
5,764,535 A * 6/1998 Okazaki et al. ..... 364/503

(Continued)

FOREIGN PATENT DOCUMENTS

GB 2 423 158 * 8/2006
JP 62-294804 * 12/1987

OTHER PUBLICATIONS

Search Report under section 17(5) issued in GB0610955.7 application by United Kingdom Patent Office on Nov. 7, 2006.

(Continued)

*Primary Examiner* — Aditya Bhat
(74) *Attorney, Agent, or Firm* — Marshall, Gerstein & Borun LLP

(57) ABSTRACT

A statistical performance evaluation system for a thermodynamic device and process uses the achievable performance derived from statistics and real-time data for the device or process to evaluate the current performance of the device or process, and to adjust the operations of the device or process accordingly, or provide feedback to an operator or other monitoring system for taking corrective actions to obtain performance approaching the optimum achievable performance. The achievable performance of the device or process is derived from data collected during operational periods when the best achievable performance is anticipated, such as after maintenance is performed, and supersedes the ideal or design performance specified by the manufacturer, which typically does not represent the actual operating conditions in the field, as the basis for evaluating the real-time performance of the device. The statistical performance evaluation system may set desired upper and lower limits for performance parameters, and compare desired limits to the actual performance parameter values to determine the readjustment to be made to the operation of the device or process.

31 Claims, 9 Drawing Sheets

U.S. PATENT DOCUMENTS

| | | | | |
|---|---|---|---|---|
| 6,325,025 | B1 * | 12/2001 | Perrone | 122/379 |
| 6,736,089 | B1 * | 5/2004 | Lefebvre et al. | 122/379 |
| 6,758,168 | B2 * | 7/2004 | Koskinen et al. | 122/7 R |
| 7,047,158 | B2 * | 5/2006 | Roba et al. | 702/182 |
| 7,109,446 | B1 * | 9/2006 | Cheng et al. | 219/497 |
| 2001/0034582 | A1 * | 10/2001 | Umezawa et al. | 702/136 |
| 2005/0033464 | A1 * | 2/2005 | Nguyen | 700/108 |
| 2007/0012085 | A1 * | 1/2007 | Higashide | 73/1.01 |

OTHER PUBLICATIONS

International Search Report issued in PCT/US2008/056699 application mailed Aug. 28, 2008.

Written Opinion issued in PCT/US2008/056699 application mailed Aug. 28, 2008.

* cited by examiner

METHOD AND APPARATUS FOR GENERALIZED PERFORMANCE EVALUATION OF EQUIPMENT USING ACHIEVABLE PERFORMANCE DERIVED FROM STATISTICS AND REAL-TIME DATA

REFERENCE TO RELATED APPLICATIONS

This application is a continuation-in-part of U.S. patent application Ser. No. 11/146,170, filed Jun. 6, 2005, entitled "Method and Apparatus for Controlling Soot Blowing Using Statistical Process Control," and claims the benefit of priority to U.S. Provisional Patent Application No. 60/894,339, filed on Mar. 12, 2007, entitled "Statistical Analysis in Power Plant Performance," which are hereby expressly incorporated by reference herein.

TECHNICAL FIELD

This patent relates generally to computer software, and more particularly to computer software used in monitoring and controlling the performance of thermodynamic devices and processes.

BACKGROUND

Many of the power plants in operation today are more than 20-30 years old. During that time many changes have occurred in the plant and to plant equipment. Devices have degraded and often times been overhauled and modified mechanically. Moreover, a large number of the utility generation device burn fuels which significantly differ from the fuels for which the devices were designed to burn. As a result, the original manufacturer design curves that were developed at the time the devices were designed and installed in the power plants no longer represent the present-day operating capabilities of the devices.

The current method of performance monitoring for power plants and the devices therein was developed over 20-30 years ago for units operating with the expected conditions of the power industry at that time. The methodology then and now corresponds to the American and Western European standards of the 1960s and 1970s that emphasized reliability. At the time the methodology was developed, the methods brought many significant advantages in the form of improved quality of performance monitoring and control. However, the method is outdated by the current dynamic deregulation aspects of the power generation industry. Several basic factors contribute to the method becoming outdated. First, the advancement of computer technology that allows for the common use of digital automatic control systems. Secondly, system changes in the power energy market have made the efficacy of this method questionable under current operating conditions. Additionally, the availability of lower cost, highly precise instrumentation that is constantly being monitored and archived to a plant historian provide new opportunities for performance monitoring and comparison of the performance to best achievable performance rather than performance that may have been achievable when the power plant was constructed.

Digital automatic control systems have made constant control of performance parameters possible by assigning all parameters (and losses) on-line and permitting direct operator supervision. The increased quality of measurement devices and tools has reduced the role of periodic heat rate testing and warranty measurements. In addition, the high quality of DCS automated control connected with the increasingly common application of optimization systems (e.g., supervisory substitution or added bias signals to the operator actions during normal unit operation) has reduced the possibility of a simple improvement based on efficiency indexes. For this reason, the principle role of performance monitoring should be modified to compare actual performance to the best achievable performance for a device or process rather than the predicted performance based on the manufacturer design values, and to detect possible losses of running the in market-based generation dispatch. This change would be more meaningful and understandable to plant operations and engineering personnel.

The typical methodology of performance control is presented in numerous conference materials and textbooks. In short, the method is based on calculating the unit chemical energy usage rate, also known as unit heat rate (based on ASME Power Test Codes), and assigning the measured losses and deviations of the heat rate from the expected value (nominal, or resulting from the last warranty measurements) based on operation of the device at other than nominal conditions. The basic parameters that influence the unit heat rate and that may be taken into consideration include the main steam pressure, main steam temperature, pressure decrease in the superheater, reheat steam temperature, condenser pressure, feedwater temperature, oxygen content in flue gas and stack gas temperature. The number of controlled parameters has been expanded many times, but does not change the primary theoretical basis of this method. The heat rate deviation (BTU/kWh) is usually calculated to a value of $/Hr for a more approachable and meaningful presentation of data. Systems based on ASME or similar methodologies were introduced in practically all power plants, with modernization of automatic control systems usually developed into on-line systems performing all the calculations every several minutes and presenting the results on operators' screens at the Distributed Control System (DCS) or auxiliary computer displays.

The performance calculation methodology is necessary and effective when properly implemented, but also has a set of drawbacks. It is apparent after many years, and many computing platform revisions to calculate results, it may be possible to evaluate the results more critically and to attempt a more in depth analysis. Some of the problems with applying the contemporary performance control techniques relate to the reference values and correction curves used in the control method. Presently, most deviations and losses are calculated and monitored in reference to the so-called reference values. Usually these are the nominal values given by the original equipment manufacturer (OEM). However, for devices with a 15-40 year life cycles and with equipment that has been modernized and rebuilt at least several times, these nominal values do not constitute a real reflection of the actual operating parameters of the device in its present configuration.

Problems also arise from the correction curves used for defining the controlled or measured losses of the devices. In the present performance monitoring methods, the influence of operational parameter deviations, such as main steam temperature, main steam pressure, and the like, from the design values (i.e. achievable, design, theoretical) are assigned largely using the so-called manufacturers' correction curves. Leaving the accuracy of these curves and the common problems with obtaining this data aside, the basis of his theory is to define the influence of these parameters ($x_i$) (gradient) into unit heat rate ($q_b$)-$\partial q_b/\partial x_i$. The manufacturer's data normally does not correspond to the real, dynamic operation of a modernized unit. At the same time, there appears to be a theoretical problem with assigning the deviation for the given control value. In the case of building a correction curve, it is assumed that a clear assignment of the influence of a given value onto unit heat rate will be possible ($q_b$). In other words, variables such as pressure and temperature are treated as independent variables which finally leads to obtaining a dependence $\partial q_b/\partial x_i = f(x_i)$. This results from, among other factors, the method of assigning correction curves through balance calculations and the change of an individual parameter in simulation calculations.

In actual practice, a strong relationship exists between these parameters during normal operation, and the parameters are interrelated. The relationships can be derived by utilizing statistical techniques. During normal operations, it is not possible to change one parameter without modifying others. Additionally, assigning relationships between these parameters is not only dependent on the thermodynamic dependencies (balance) but it is also influenced by the operation of the automatic control system controlling the unit. In other words, in practice when changing one of the main unit operational parameters, the automatic control systems perform a shift of the unit status into a different operating point, thus modifying the other parameters. Because of this, deviations assigned using correction curves cease to have any practical significance. For example, at a given moment deviations of a unit heat rate for a series of main parameters are assigned, and a negative deviation for one of the parameters resulting from the difference between the current and the nominal or reference value may be obtained. Canceling this difference by bringing the parameter to the nominal or reference value and thus reducing the deviation while the other parameters remain unchanged results in an entirely different system of parameters and differences of the parameters from reference values, and potentially new deviations in their values from the reference values where deviations did not previously exist.

Consequently, a need exists for using statistical data based analysis and control of the present-day operating conditions to determine the achievable and statistically controllable performance of thermodynamic devices and processes and to improve on the currently applied systems for performance monitoring by taking into account the statistically achievable performance rather than a theoretical or designed ideal performance level.

One specific example of an application where improved performance monitoring may benefit thermodynamic devices or processes is in fuel burning boilers where soot blowing is performed to adjust the efficiency of heat transfer within the boilers. A variety of industrial as well as non-industrial applications use fuel burning boilers, typically for converting chemical energy into thermal energy by burning one of various types of fuels, such as coal, gas, oil, waste material, etc. An exemplary use of fuel burning boilers is in thermal power generators, wherein fuel burning boilers are used to generate steam from water traveling through a number of pipes and tubes in the boiler and the steam is then used to generate electricity in one or more turbines. The output of a thermal power generator is a function of the amount of heat generated in a boiler, wherein the amount of heat is determined by the amount of fuel that can be burned per hour, etc. Additionally, the output of the thermal power generator may also be dependent upon the heat transfer efficiency of the boiler used to burn the fuel.

Burning of certain types of fuel, such as coal, oil, waste material, etc., generates a substantial amount of soot, slag, ash and other deposits (generally referred to as "soot") on various surfaces in the boilers, including the inner walls of the boiler as well as on the exterior walls of the tubes carrying water through the boiler. The soot deposited in the boiler has various deleterious effects on the rate of heat transferred from the boiler to the water, and thus on the efficiency of any system using such boilers. It is necessary to address the problem of soot in fuel burning boilers that burn coal, oil, and other such fuels that generate soot in order to maintain a desired efficiency within the boiler. While not all fuel burning boilers generate soot, for the remainder of this patent, the term "fuel burning boilers" is used to refer to those boilers that generate soot.

Various solutions have been developed to address the problems caused by the generation and presence of soot deposits in boilers of fuel burning boilers. One approach is the use of soot blowers to remove soot encrustations accumulated on boiler surfaces through the creation of mechanical and thermal shock. Another approach is to use various types of soot blowers to spray cleaning materials through nozzles, which are located on the gas side of the boiler walls and/or on other heat exchange surfaces, where such soot blowers use any of the various media such as saturated steam, superheated steam, compressed air, water, etc., for removing soot from the boilers.

Soot blowing affects the efficiency and the expense of operating a fuel burning boiler. For example, if inadequate soot blowing is applied in a boiler, it results in excessive soot deposits on the surfaces of various steam carrying pipes and therefore in lower heat transfer rates. In some cases, inadequate soot blowing may result in "permanent fouling" within fuel burning boilers, meaning that soot deposits in the boiler are so excessive that such deposits cannot be removed by any additional soot blowing. In such a case, forced outage of the boiler operation may be required to fix the problem of excessive soot deposits, and boiler maintenance personnel may have to manually remove the soot deposits using hammers and chisels. Such forced outages are not only expensive, but also disruptive for the systems using such fuel burning boilers.

On the other hand, excessive soot blowing in fuel burning boilers may result in increased energy cost to operate the soot blowers, wastage of steam that could otherwise be used to operate turbines, etc. Excessive soot blowing may also be linked to boiler wall tube thinning, tube leaks, etc., which may cause forced outages of boiler use. Therefore, the soot blowing process needs to be carefully controlled.

Historically, soot blowing in utility boilers has been mostly an ad hoc practice, generally relying on a boiler operator's judgment. Such an ad hoc approach produces very inconsistent results. Therefore, it is important to manage the process of soot blowing more effectively and in a manner so that the efficiency of boiler operations is maximized and the cost associated with the soot blowing operations is minimized.

One popular method used for determining cleanliness of a boiler section and to control soot blowing operations is a first principle based method, which requires measurements of flue gas temperature and steam temperature at the boiler section inlets and outlets. However, because direct measurements of flue gas temperatures are not always available, the flue gas temperatures are often backward calculated at multiple points along the path of the flue gas, starting from the flue gas temperatures measured at an air heater outlet. This method is quite sensitive to disturbances and variations in air heater outlet flue gas temperatures, often resulting in incorrect results. Moreover, this method is a steady state method, and therefore does not work well in transient processes generally encountered in various boiler sections.

Another popular method used for determining cleanliness of a boiler section of a fuel burning boiler and to control soot blowing operations in a fuel burning boiler is an empirical model based method, which relies on an empirical model such as a neural network model, a polynomial fit model, etc. The empirical model based method generally requires a large quantity of empirical data related to a number of parameters, such as the fuel flow rate, the air flow rate, the air temperature, the water/steam temperature, the burner tilt, etc. Unfortunately the large amount of data makes the data collection process tedious and prone to high amount of errors in data collection. The model may also be similar to the performance monitoring method discussed above and using reference values and correction curves among other information from the manufacturer. As discussed above, this method evaluates the performance based on the manufacturer's design instead of the optimum achievable performance of the soot blowing operation under the current operating conditions.

BRIEF DESCRIPTION OF THE DRAWINGS

The present patent is illustrated by way of examples and not limitations in the accompanying figures, in which like references indicate similar elements, and in which.

DETAILED DESCRIPTION OF THE EXAMPLES

Since modern day control systems make it possible to archive the plant performance data over a long period of time, it is possible to analyze this data using statistical techniques to determine the best achievable performance of a device or process. Statistics and real time plant data can be used to analyze plant data to determine the achievable operating range for a piece of equipment such as a pump, a compressor, and the like, or for an overall process. The analysis should be done soon after a piece of equipment has been serviced or at another time when the equipment or process is considered to be in the best condition. After the achievable operating range is determined, the data distributions for pieces of equipment and processes are observed or monitored over time to determine the actual operating ranges for the equipment/processes during normal operations. The monitoring is also performed to identify when variations from the achievable performance are observed.

Whenever the data distribution for the actual operating ranges has a significant movement that exceeds a predetermined allowable deviation from the achievable operating range, the piece of equipment or the process may be in need of service. The maximum allowable or tolerable deviation may be determined from operation experience or from a sensitivity analysis of the data. Operations personnel and engineering can be notified of the deviation from the achievable operating range and take the necessary corrective actions. Over time, as a knowledge base is developed of deviations from the achievable operating ranges for the equipment and their likely causes, the control system may be configured to automatically take corrective actions where possible or, at a minimum, to suggest corrective actions to the operations personnel and engineers.

The procedure discussed above has general applicability to thermodynamic processes in both industrial and non-industrial environments. As used herein, the term process may refer generally to a thermodynamic process occurring within a single device, such as a soot blower, a heat exchanger, a pump, a turbine and the like, or a thermodynamic process involving multiple thermodynamic devices and steps, such as heat exchange sections and other subsystems with power plants, automobile engines, and the like wherein both the achievable performance and the actual performance of the device(s) and process(es) may be determined. The discussion below illustrates one application wherein this generalized approach could be applied to soot blowing within a heat exchange section. Another example where this generalized approach can be applied is in the calculation of power plant controllable losses.

Figure 1:
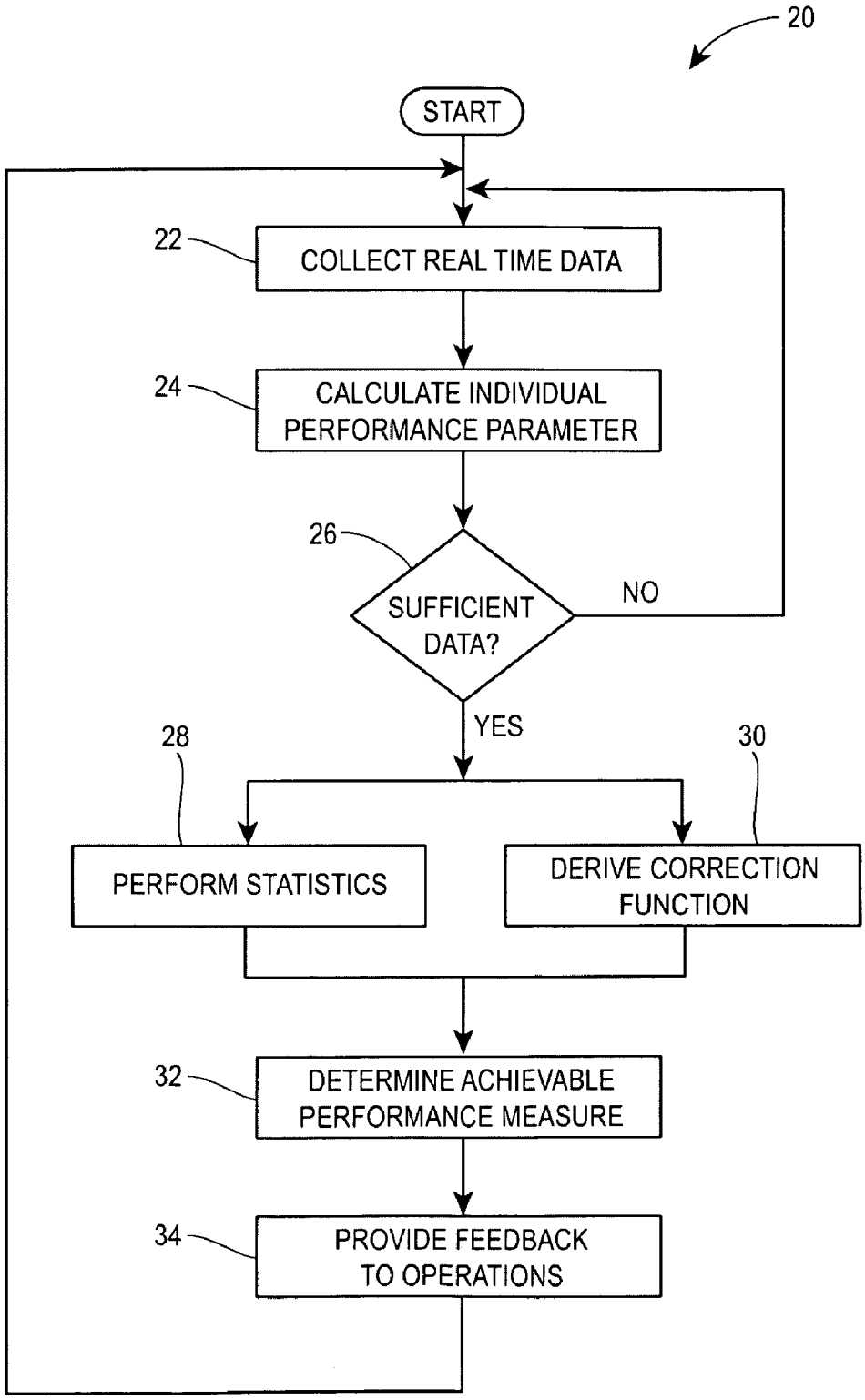
FIG. 1 illustrates a flowchart of an exemplary achievable performance evaluation routine.

FIG. 1 contains a generalized flowchart of the steps of an achievable performance evaluation routine 20 used to derive accurate correction functions for individual parameters (main steam temperature and pressure, exhaust gas temperature and pressure, fluid flow rates and the like) of a thermodynamic device or process based on the present day operating conditions of the equipment. The achievable performance evaluation routine 20 may be implemented as software, hardware, firmware or as any combination thereof. When implemented as software, the achievable performance evaluation routine 20 may be stored on a read only memory (ROM), a random access memory (RAM) or any other memory device used by a computer used to implement the achievable performance evaluation routine 20. The achievable performance evaluation routine 20 may be used to calculate and evaluate statistics of only a device or portion of a thermodynamic process or, alternatively, may be used to calculate and evaluate statistics of the entire process. Ideally the routine 20 is executed after the equipment is overhauled or other maintenance has performed, after equipment is replaced, or at any other time at which the devices or processes are contemplated to perform at the maximum achievable performance levels. For example, the routine 20 may be executed after a boiler section is taken out of service to have permanent deposits of soot removed, or after an engine is rebuilt. The evaluation may be performed during a separate testing period before the devices or processes are placed back into normal service, or the evaluation may be performed at the time the devices or processes are placed back into service for the duration of time necessary to collect the necessary data to perform the evaluation.

The achievable performance evaluation routine 20 may begin at a block 22 where real time operating data is collected for each controllable loss parameter for the thermodynamic process. Because the devices or processes typically operate at different load levels at various times during normal operations, the devices or processes may be operated over the anticipated load levels to ensure that data is collected for all load ranges at which the devices or processes may operate. As data is collected, a block 24 calculates the individual performance parameters that are relevant for evaluating and controlling the performance of the devices and/or the process. In some instances, relevant parameters may be directly measurable by the available monitoring devices (e.g., temperatures, pressures and flow rates). In other cases, the parameters are the results of calculations that must be performed due to the nature of the parameter, such as the heat absorption within a boiler section, or to the inability to accurately monitor the value of an otherwise measurable parameter. The operating data is collected until there is a sufficient amount of data for each load range to perform the necessary evaluation of the achievable performance of the device or process. A user may have specified a number of observations that must be collected over range of loads, or may have specified a time period that must elapse to ensure that sufficient data is collected for the process. If insufficient data has been collected at a block 26, control passes back to the block 22 for the collection of additional operating data.

Once the block 26 determines that a sufficient amount of operating data has been collected, analysis may be performed on the data to determine the achievable performance of the device or process as a function of the performance parameters. Control may pass to a block 28 to perform statistical analysis of the operating data. For example, for each relevant performance parameter, the block 28 may calculate the mean value, the median value, standard deviation, variance, skewness and other statistical values at the various operating loads. The observed operating data also provide distribution curves for the process parameters at the achievable operating conditions. After sufficient operating data is collected, control may also pass to a block 30 to derive correction functions that may be substituted for the manufacturer-supplied correction curves or the most recently derived correction functions from the previous execution of the achievable performance evaluation routine 20. The correction functions may be derived by applying statistical analysis techniques to the operating data to determine degrees of correlation between the performance parameters and the overall performance of the monitored device or process. One example of such a statistical analysis is provided in co-pending U.S. patent application Ser. No. 11/_____filed on Mar. 12, 2008, by Cheng et al., entitled "Use of Statistical Analysis in Power Plant Performance Monitoring," which is expressly incorporated by reference herein.

Figure 2:
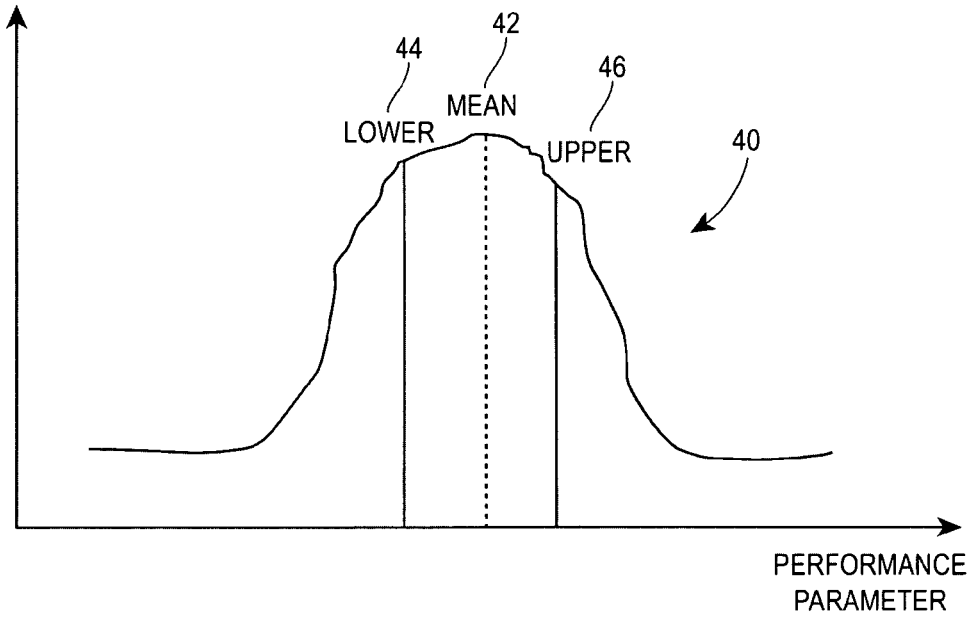
FIG. 2 illustrates an exemplary data distribution curve for a thermodynamic parameter of a monitored device or process.

Once the statistical analysis is performed at the block 28 and the correction functions are derived at the block 30, control may pass to a block 32 to determine the achievable performance for the device or process and the appropriate performance parameters to be used for monitoring, evaluating and controlling the real time performance of the device or process versus the achievable performance. For example, the achievable performance measure may be the performance parameter the value of which most closely correlates to the achievable performance of the device or process. In the case of a boiler section, the calculated heat absorption as the steam passes through the boiler section may provide the most accurate indication of the performance of the section. In an internal combustion engine, the exhaust gas temperature or pressure may be the appropriate performance parameter to measure. Moreover, for a given performance parameter, the operational data and statistical analysis are used to determine the best achievable operating range for the parameters for each load range of the plant. For example, FIG. 2 illustrates an exemplary distribution curve 40 of observations for a performance parameter for a monitored device or process for a given load. The observations are distributed about a mean value 42 of the performance parameter, and the device or process may be operating at the achievable level of performance at the load when the performance parameter has a value between a lower limit 44 and an upper limit 46 assuming other correlated performance parameters are also operating within their corresponding limits. Returning to FIG. 1, once the achievable performance measures are determined, control passes to a block 34 where the information is provided as feedback to operations or other monitoring personnel or systems for use in ensuring that the device or process is operating within the desired and/or achievable operating range. Additionally, using other statistical techniques, the heat rate correction function that should be applied to the parameter(s) is derived. Once the correction function is derived, the controllable loss for the parameter in $/HR can be calculated as discussed above. The correction factor will now be determined by the actual device or process data rather than the manufacturer design data.

Using the achievable performance measures, statistical data and correction functions derived by the achievable performance evaluation routine 20, the performance of a device or process may be monitored and evaluated based on the achievable performance of the particular device or process being monitored instead of an ideal and potentially unattainable theoretical level of performance. Over time, the actual performance of the device or process may shift from the achievable curve 40 shown in FIG. 2. When the actual performance is sufficiently divergent from the achievable performance, the performance parameter(s) should be adjusted, if possible, to improve the performance of device or process to meet the achievable performance or to match that level of performance as closely as possible.

Figure 3:
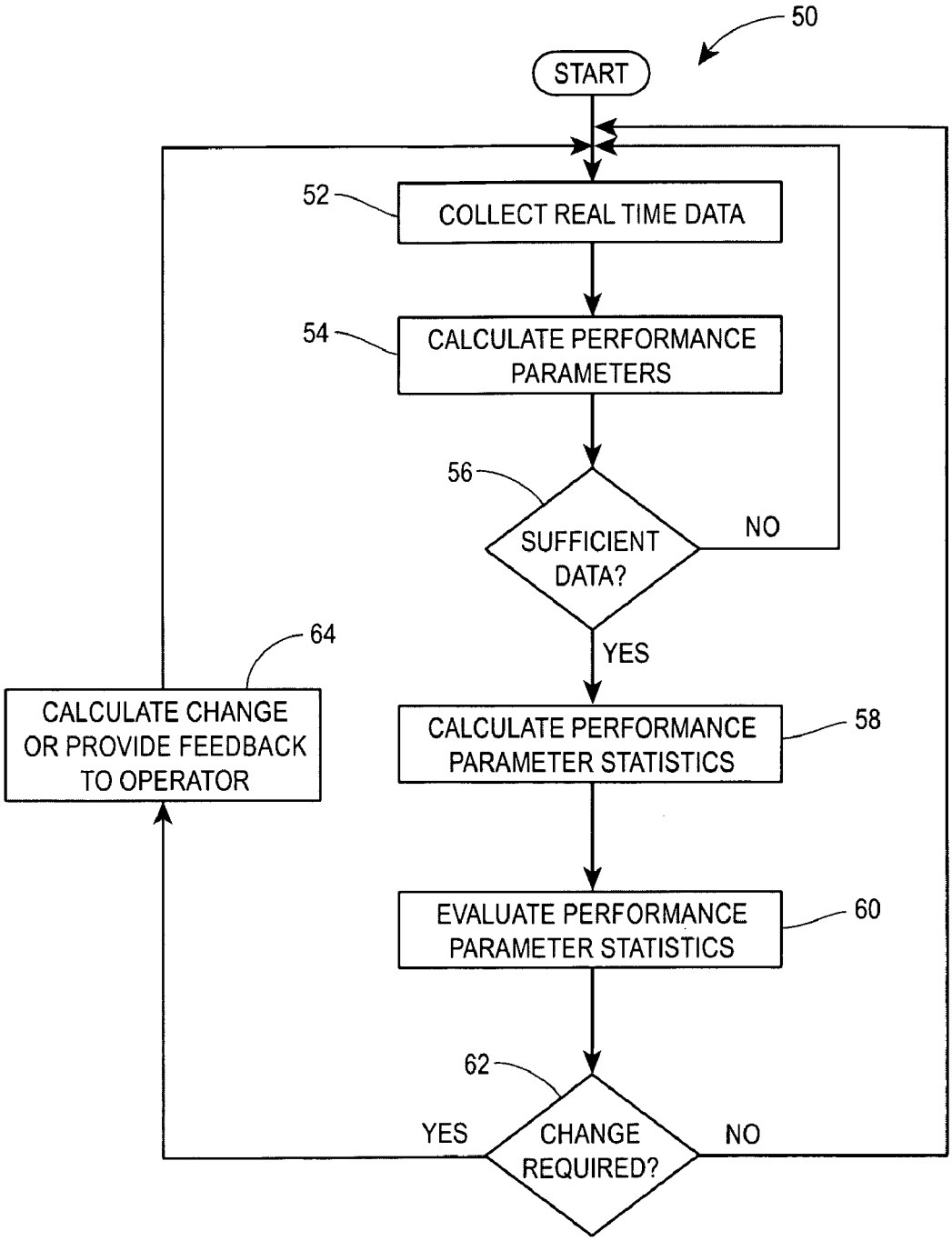
FIG. 3 illustrates a flowchart of a generalized performance evaluation routine.

FIG. 3 contains a generalized flowchart of an actual performance evaluation routine 50 that may be used to evaluate the performance of the thermodynamic device or process and provide feedback to operations personnel or to any other persons or systems monitoring and controlling the device or process. As with the achievable performance evaluation routine 20, the performance evaluation routine 50 may be implemented as software, hardware, firmware or as any combination thereof. When implemented as software, the performance evaluation routine 50 may be stored on a ROM, a RAM or any other memory device used by a computer used to implement the performance evaluation routine 50. The performance evaluation routine 50 may be used to calculate and evaluate statistics of only a device or portion of a thermodynamic process or, alternatively, may be used to calculate and evaluate statistics of the entire process.

A block 52 initiates the evaluation of the device or process by collecting real time data for the current operational state of the monitored device or process. The collected operational data may be similar to the operational data collected are the block 22 of the achievable performance evaluation routine 20 for performance parameters that may be directly measured or for performance parameters that may be derived from measurable data. It should be noted that the routines 20 and 50 may be executed concurrently at a time when the device or process is expected to operate at the achievable performance level, or may be combined in a single routine that is configured to perform the achievable performance evaluation during normal operations when the performance of the device or process at times when the optimal performance should be achieved. As the operational data is collected, a block 54 calculates and stores performance parameter(s) used to compare the current performance the achievable performance in a similar manner as the block 24.

A block 56 evaluates the amount of operational data collected and stored by the blocks 52, 54. For example, a user may have specified the number of observations that must be collected by the performance evaluation routine 50, in which case the block 56 compares the collected data with such a specification provided by the user. If the block 56 determines that more data is necessary, control passes back to the block 52. When the block 56 determines that a sufficient amount of operational data has been collected, a block 58 calculates a plurality of statistical data for the performance parameter(s) of the monitored device or process. For example, the block 58 may calculate a mean value, a median value, variance, standard deviation, skewness, and other statistical values that may be relevant to evaluating the real time performance of the device or process.

Subsequently, a block 60 evaluates the statistical data calculated by the block 58. In particular, the block 60 may evaluate the statistical data for the performance parameters against a number of measures provided by a user of the performance evaluation routine 50 or against a number of industry averages that may be relevant to the real time operation of the device or process. In an implementation of the performance evaluation routine 50 such as that discussed further below, the block 60 may be provided with a target lower control limit and a target upper control limit against which the distribution of a performance parameter is evaluated. Alternatively, the performance evaluation routine 50 may calculate the target lower control limit and the target upper control limit using the statistical data calculated by the achievable performance evaluation routine 20 for the performance parameter. For example, an implementation of the performance evaluation program 50 may determine a target lower control limit and the target upper control limit using the achievable mean and the achievable standard deviation for the performance parameter.

After evaluating the performance parameter statistics at the block 60, a block 62 determines if it is necessary to change the current operation of the device or process. For example, the block 62 may determine that it is necessary to change one or more of the setpoints for measurable parameters to move the distribution of the performance parameter toward the achievable distribution of curve 40. The particular adjustment or parameter that may be adjusted may be determined based on the manner in which the actual distribution varies from the achievable distribution. For example, it may be necessary to increase or decrease the value of one parameter, or to take the device or process out of service and perform maintenance, where the real time distribution curve is shifted to the left or right from the achievable curve 40, but a different parameter or parameters may be adjusted where the real time distribution curve is broader or narrower than the achievable distribution curve 40.

If the block 62 determines that it is necessary to change the current operational configuration of the device or process, a block 64 may calculate a change to be applied to any of the various parameters of the device or process, or provide feedback to the operator to assist in determining the necessary corrective action. The block 64 may use various statistics calculated by the block 58 to determine the change to be applied to the operating parameters. Alternatively, over time a knowledge base may be developed that provides solutions or guidance to the operator as to the most likely cause or causes of the degradation in performance and the available corrective actions that may be taken. The guidance may include indications of whether certain corrective actions are within the permissible operational limits established by the achievable correction curves derived by the achievable performance evaluation routine 20. Of course, the block 62 may also determine that the device or process is working effectively, and that it is not necessary to change the current operation, in which case the control may transfer to the block 52 for continuous monitoring of the device or process without any changes.

Returning to our specific example of soot blowing in a fuel burning boiler, a statistical process control system employs a consistent soot blowing operation for a heat exchange section of, for example, a fuel burning boiler, collects heat absorption data for the heat exchange section and analyzes the distribution of the heat absorption data as well as various parameters of the heat absorption distribution to readjust the soot blowing operation. The statistical process control system may set a desired lower heat absorption limit and a desired upper heat absorption limit and compare them, respectively, with an actual lower heat absorption limit and an actual upper heat absorption limit to determine the readjustment to be made to the soot blowing practice.

Generally speaking, the statistical process control system described herein is more reliable than the first principle based method and the empirical model based method, and is simple to implement as the statistical process control system requires only heat absorption data for implementation. Moreover, because the statistical process control system described herein uses heat absorption data, it is independent of, and not generally effected by disturbances and noise in flue gas temperatures, thus providing more uniform control over operation of soot blowers and cleanliness of heat exchange sections.

Generally speaking, an implementation of the statistical process control system measures heat absorption at various points over time to determine differences in heat absorption before and after a soot blowing operation, and calculates various statistical process control measurements based on such heat absorption statistics to determine the effectiveness of the soot blowing operation. The statistical process control system establishes a consistent soot blowing operation for the heat exchange section of a boiler or other machines and reduces the amount of data necessary for controlling the operation of the soot blowers.

Figure 4:
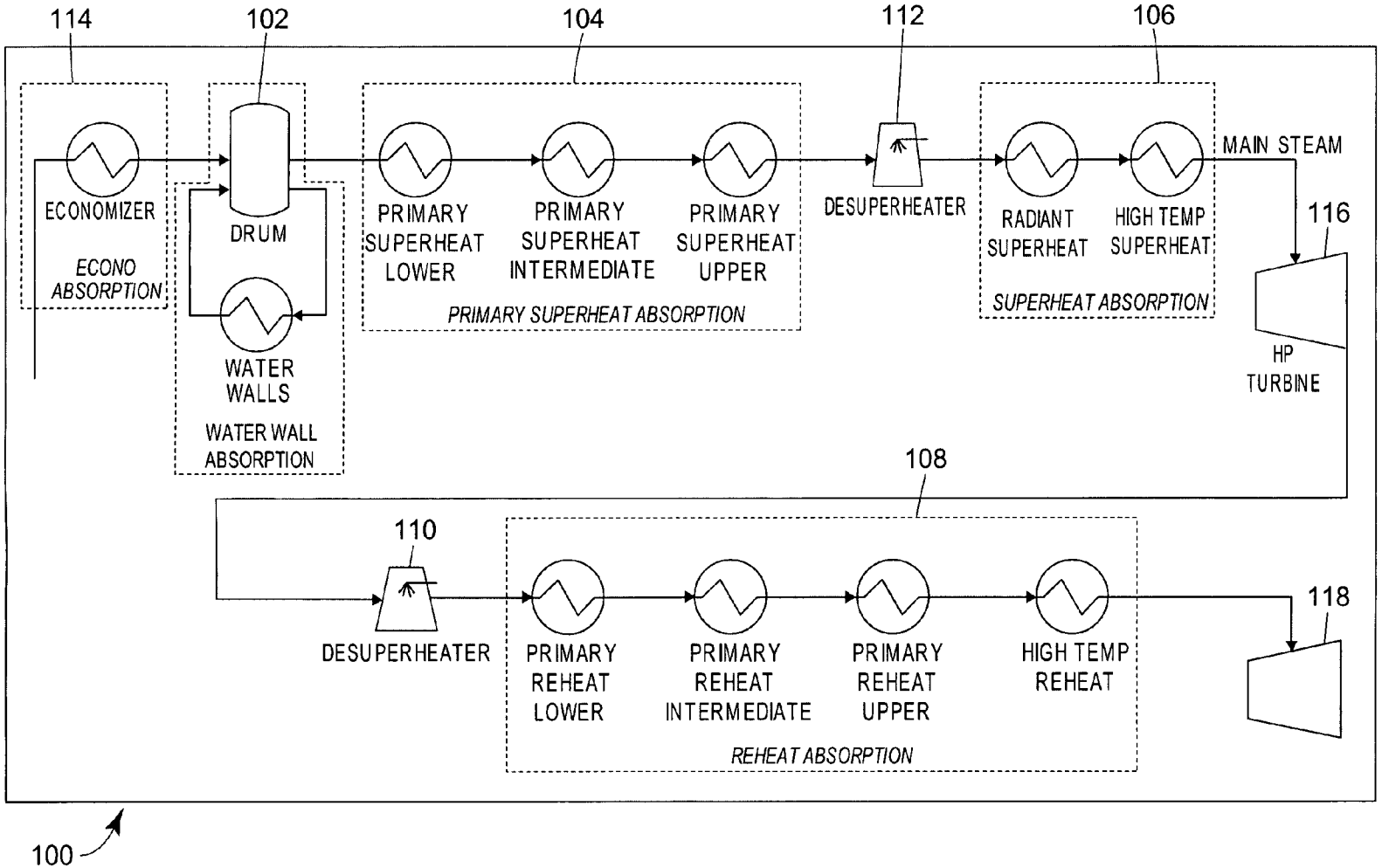
FIG. 4 illustrates a block diagram of a boiler steam cycle for a typical boiler.

FIG. 4 illustrates a block diagram of a boiler steam cycle for a typical boiler 100 that may be used, for example, by a thermal power plant. The boiler 100 may include various sections through which steam or water flows in various forms such as superheated steam, reheat steam, etc. While the boiler 100 illustrated in FIG. 4 has various boiler sections situated horizontally, in an actual implementation, one or more of these sections may be positioned vertically, especially because flue gases heating the steam in various boiler sections, such as a water wall absorption section, rise vertically.

The boiler 100 includes a water wall absorption section 102, a primary superheat absorption section 104, a superheat absorption section 106 and a reheat section 108. Additionally, the boiler 100 may also include one or more de-superheaters 110 and 112 and an economizer section 114. The main steam generated by the boiler 100 is used to drive a high pressure (HP) turbine 116 and the hot reheat steam coming from the reheat section 108 is used to drive an intermediate pressure (IP) turbine 118. Typically, the boiler 100 may also be used to drive a low pressure (LP) turbine, which is not shown in FIG. 4.

The water wall absorption section 102, which is primarily responsible for generating steam, includes a number of pipes through which steam enters a drum. The feed water coming into the water wall absorption section 102 may be pumped through the economizer section 114. The feed water absorbs a large amount of heat when in the water wall absorption section 102. The water wall absorption section 102 has a steam drum, which contains both water and steam, and the water level in the drum has to be carefully controlled. The steam collected at the top of the steam drum is fed to the primary superheat absorption section 104, and then to the superheat absorption section 106, which together raise the steam temperature to very high levels. The main steam output from the superheat absorption section 106 drives the high pressure turbine 116 to generate electricity.

Once the main steam drives the HP turbine 116, the steam is routed to the reheat absorption section 108, and the hot reheat steam output from the reheat absorption section 108 is used to drive the IP turbine 118. The de-superheaters 110 and 112 may be used to control the final steam temperature to be at desired set-points. Finally, the steam from the IP turbine 118 may be fed through an LP turbine (not shown here) to a steam condenser (not shown here), where the steam is condensed to a liquid form, and the cycle begins again with various boiler feed pumps pumping the feed water for the next cycle. The economizer section 114 that is located in the flow of hot exhaust gases exiting from the boiler uses the hot gases to transfer additional heat to the feed water before the feed water enters the water wall absorption section 102.

Figure 5:
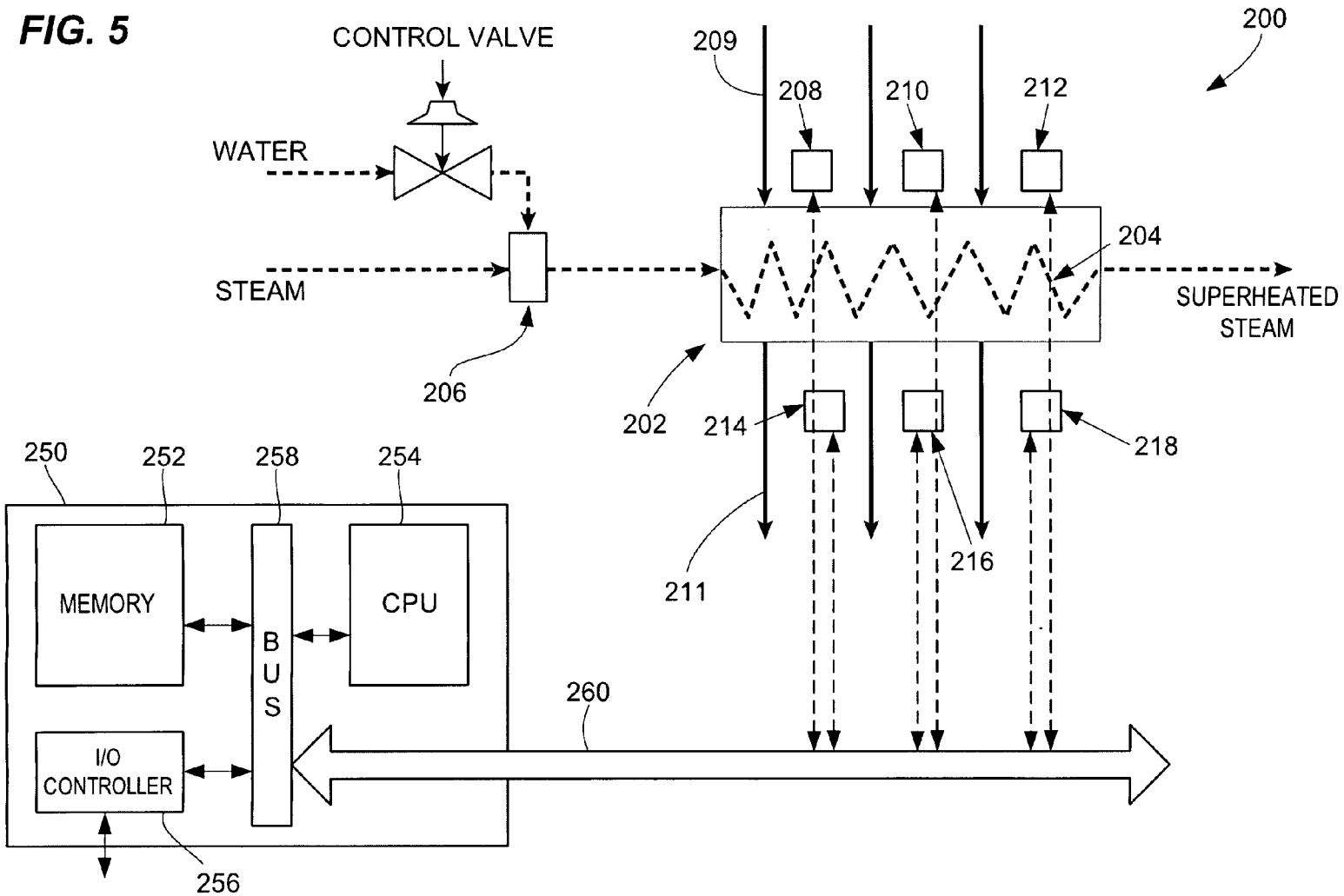
FIG. 5 illustrates a schematic diagram of an exemplary boiler section using a plurality of soot blowers.

FIG. 5 is a schematic diagram of a boiler section 200 having a heat exchanger 202 located in the path of flue gas from the boiler 100. The boiler section 200 may be part of any of the various heat exchange sections described above, such as the primary superheat absorption section 104, the reheat absorption section 108, etc. One of ordinary skill in the art would appreciate that, while the present example of the boiler section 200 may be located in a specific part of the boiler 100, the soot blower control method illustrated in this patent can be applied to any section of the boiler where heat exchange and soot build-up may occur.

The heat exchanger 202 includes a number of tubes 204 for carrying steam which is mixed together with spray water in a mixer 206. The heat exchanger 202 may convert the mixture of the water and steam to superheated steam. The flue gases input to the reheat section 200 are shown schematically by the arrows 209, and the flue gases leaving the boiler section 200 are shown schematically by the arrows 211. The boiler section 200 is shown to include six soot blowers 208, 210, 212, 214, 216 and 218, for removal of soot from the external surface of the heat exchanger 202.

The operation of the soot blowers 208, 210, 212, 214, 216 and 218 may be controlled by an operator via a computer 250. The computer 250 may be designed to store one or more computer programs on a memory 252, which may be in the form of random access memory (RAM), read-only memory (ROM), etc., wherein such a program may be adapted to be processed on a central processing unit (CPU) 254 of the computer 250. A user may communicate with the computer 250 via an input/output controller 256. Each of the various components of the computer 250 may communicate with each other via an internal bus 258, which may also be used to communicate with an external bus 260. The computer 250 may communicate with each of the various soot blowers 208, 210, 212, 214, 216 and 218 using the external communication bus 260.

The soot blowers 208-218 may be operated according to a particular soot blowing sequence, specifying the order in which each of the soot blowers 208-218 is to be turned on, the frequency of operation of the soot blowers 208-218, the length of time each soot blower is on, etc. While a given section of a fuel burning boiler may have a number of different heat exchange sections, the supply of steam and water that may be used for soot blowing operations is limited. Therefore, each heat exchange section is assigned a priority level according to which the soot blowers of that heat exchange section are operated. Soot blowers in a heat exchange section with a higher priority will receive needed water and steam to operate fully and the soot blowers in heat exchange sections with lower priorities will operate only when the needed water and steam are available. As described in further detail below, the priority level of a particular heat exchange section may be changed according to a program implemented for controlling the soot blowers of that particular heat exchange section.

Figure 6:
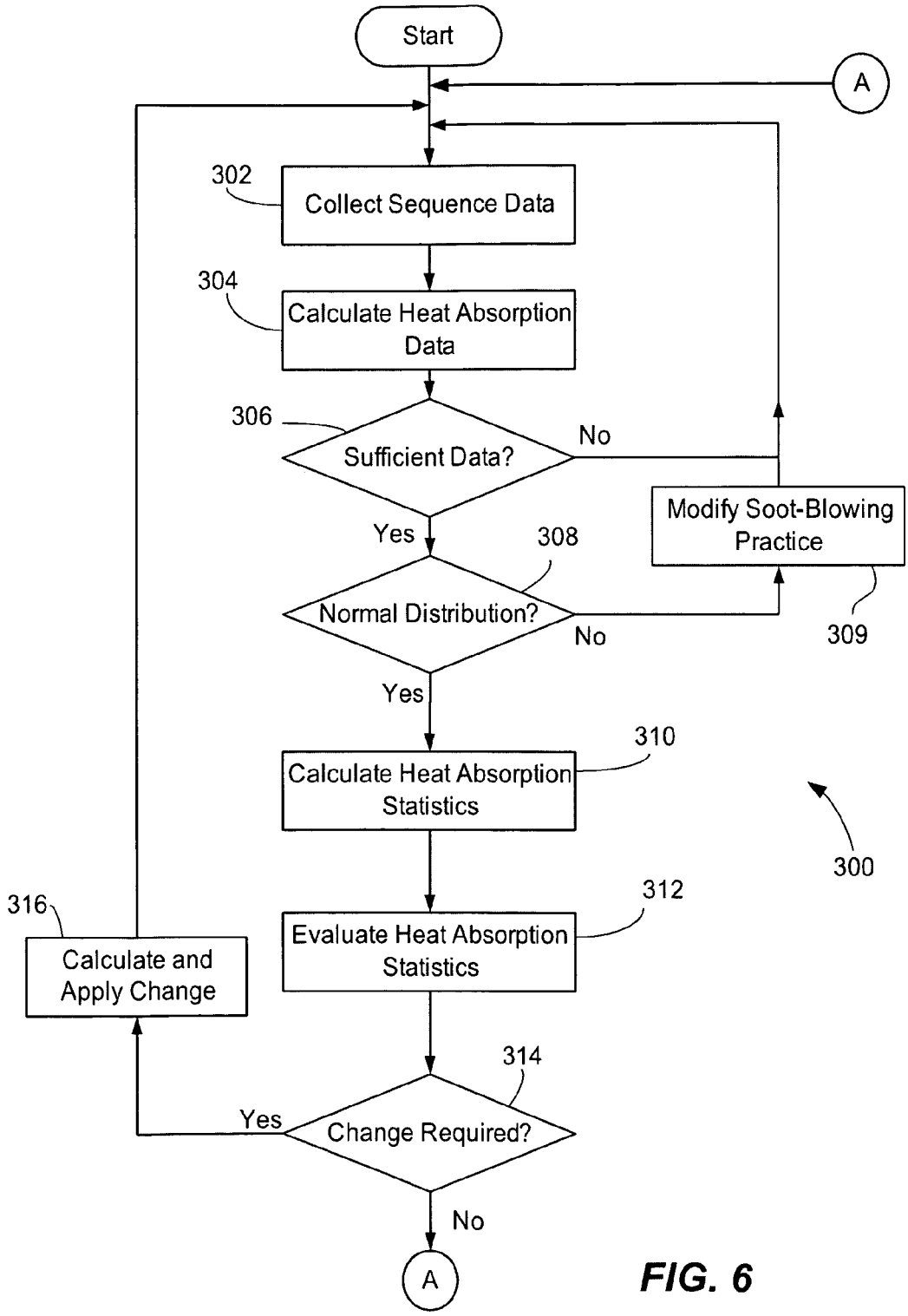
FIG. 6 illustrates a flowchart of an exemplary heat absorption statistics calculation program.

FIG. 6 illustrates a flowchart of a heat absorption statistics calculation program 300 that may be used to calculate heat absorption statistics in any of the various sections of the boiler 100, such as the boiler section 200. The heat absorption statistics calculation program 300 may be implemented as software, hardware, firmware or as any combination thereof. When implemented as software, the heat absorption statistics calculation program 300 may be stored on a read only memory (ROM), a random access memory (RAM) or any other memory device used by a computer used to implement the soot blowing process control program 300. The heat absorption statistics calculation program 300 may be used to calculate heat absorption statistics of only one section of the boiler 100 or, alternatively, may be used to calculate heat absorption statistics of all the heat exchange sections in the boiler 100.

A block 302 initiates the calculation of heat absorption statistics by establishing an initial sequence of operation (current operational sequencing). Such current operational sequencing may be characterized by various parameters defining a timeline for operating each of the plurality of soot blowers within a boiler section, such as the boiler section 200. For example, an implementation of the heat absorption statistics calculation program 300 may specify the frequency at which the soot blower 208 is turned on, the length of time for which the soot blower 208 is kept on, and the length of time for which the soot blower 208 is turned off between two consecutive on time periods.

The block 302 also collects and stores various data related to the steam flowing through the boiler section 200. For example, the block 302 may collect the temperature and pressure of the steam entering the boiler section 200 and may calculate the entering enthalpy of the boiler section 200 (enthalpy is the heat energy content of a fluid, which has a unit of Btu/lb) denoted by Hi, the temperature and pressure of the steam exiting from the boiler section 200, the exiting enthalpy of the boiler section 200, denoted by Ho, the rate of flow of steam into the boiler section 200, denoted by F lbs/Hr, etc.

A block 304 calculates and stores the heat absorption within the boiler section 200, using the data collected by the block 302. In our case, the heat absorption of the boiler section 200, denoted by Q may be given as:

$$Q=F*(H_o-H_i)$$

Alternatively, in some heat exchange sections, such as a sub-section of the water wall absorption section 102 of the boiler 100, the heat absorption Q may be measured directly using a heat flux sensor.

A block 306 of FIG. 6 evaluates the amount of heat absorption data collected and stored by the block 304. For example, a user may have specified the number of observations that must be collected by the soot blowing process control program, in which case the block 306 compares the collected data with such a specification provided by the user. If the block 306 determines that more data is necessary, control passes back to the block 302.

When the block 306 determines that a sufficient amount of heat absorption data has been collected, a block 308 determines if the collected data adheres to a normal distribution. A user may provide the confidence level at which the heat absorption statistics calculation program 300 needs to determine whether the heat absorption data is normally distributed or not. For example, a user may specify that the heat absorption data must be normally distributed at a ninety-five percent confidence level, etc. If the block 308 determines that the heat absorption data is not normally distributed at the specified confidence level, which may be a result of an erratic soot blowing sequencing, a block 309 modifies the current operational sequencing for operating the soot blowers within the boiler section 200 so that the operational sequencing is more consistent. Subsequently, the control passes back to the block 302 and more data is collected to obtain more observation points of heat absorption data.

If the block 308 determines that the heat absorption data is normally distributed, a block 310 calculates a plurality of heat absorption statistical data for the boiler section 200. For example, the block 310 may calculate a heat absorption mean, a heat absorption median, a heat absorption variance, a heat absorption standard deviation, a heat absorption skewness, etc.

Subsequently, a block 312 evaluates the heat absorption statistical data calculated by the block 310. In particular, the block 312 may evaluate the heat absorption statistical data against a number of measures provided by a user of the heat absorption statistics calculation program 300 or against a number of industry averages, etc.

In an implementation of the heat absorption statistics calculation program 300, the block 312 may be provided with a target lower control limit and a target upper control limit against which the actual heat absorption of the boiler section is evaluated. Alternatively, the heat absorption statistics calculation program 300 may calculate the target lower control limit and the target upper control limit using long term heat absorption statistical data calculated by the block 310. For example, an implementation of the heat absorption statistics calculation program 300 may determine a target lower control limit and the target upper control limit using the heat absorption mean and the heat absorption standard deviation.

After evaluating the heat absorption statistics at the block 312, a block 314 determines if it is necessary to change the current operational sequencing of the soot blowers. For example, the block 314 may determine that it is necessary to change at least one of the frequencies at which the soot blowers are turned on, the length of time that the soot blowers are kept on, the length of time that the soot blowers are turned off between two consecutive on time periods, etc. In one implementation of the heat absorption statistics calculation program 300, the block 314 may determine that if the actual heat absorption mean is lower than the target lower control limit, then it is necessary to change one or more of the operating parameters of the current operational sequencing.

If the block 314 determines that it is necessary to change the current operational sequencing of the soot blowers, a block 316 calculates a change to be applied to any of the various parameters of the current operational sequencing. The block 316 may use various heat absorption statistics calculated by the block 310 to determine the change to be applied to the operating parameters of the current operational sequencing. For example, in an implementation of the heat absorption statistics calculation program 300, the block 314 may determine that the change to be applied to the length of time for which the soot blowers are to be kept on should be a function of the difference between the actual heat absorption mean and the target lower control limit. However, the block 314 may also determine that the soot blowing is working effectively, and that it is not necessary to change the current operational sequencing of the soot blowers, in which case the control may transfer to the block 302 for continuous monitoring of the soot blowing process without any changes.

Note that while the heat absorption statistics calculation program 300 is illustrated in FIG. 5 and described above with respect to the boiler section 200, the heat absorption statistics calculation program 300 can also be applied to any other heat exchange section of the boiler 100. Moreover, while the functions performed by the blocks 312-316 are illustrated in the heat absorption statistics calculation program 300 as being performed by three different blocks, in an alternate implementation, these functions may be performed by a single block or by a separate program.

Figure 7A:
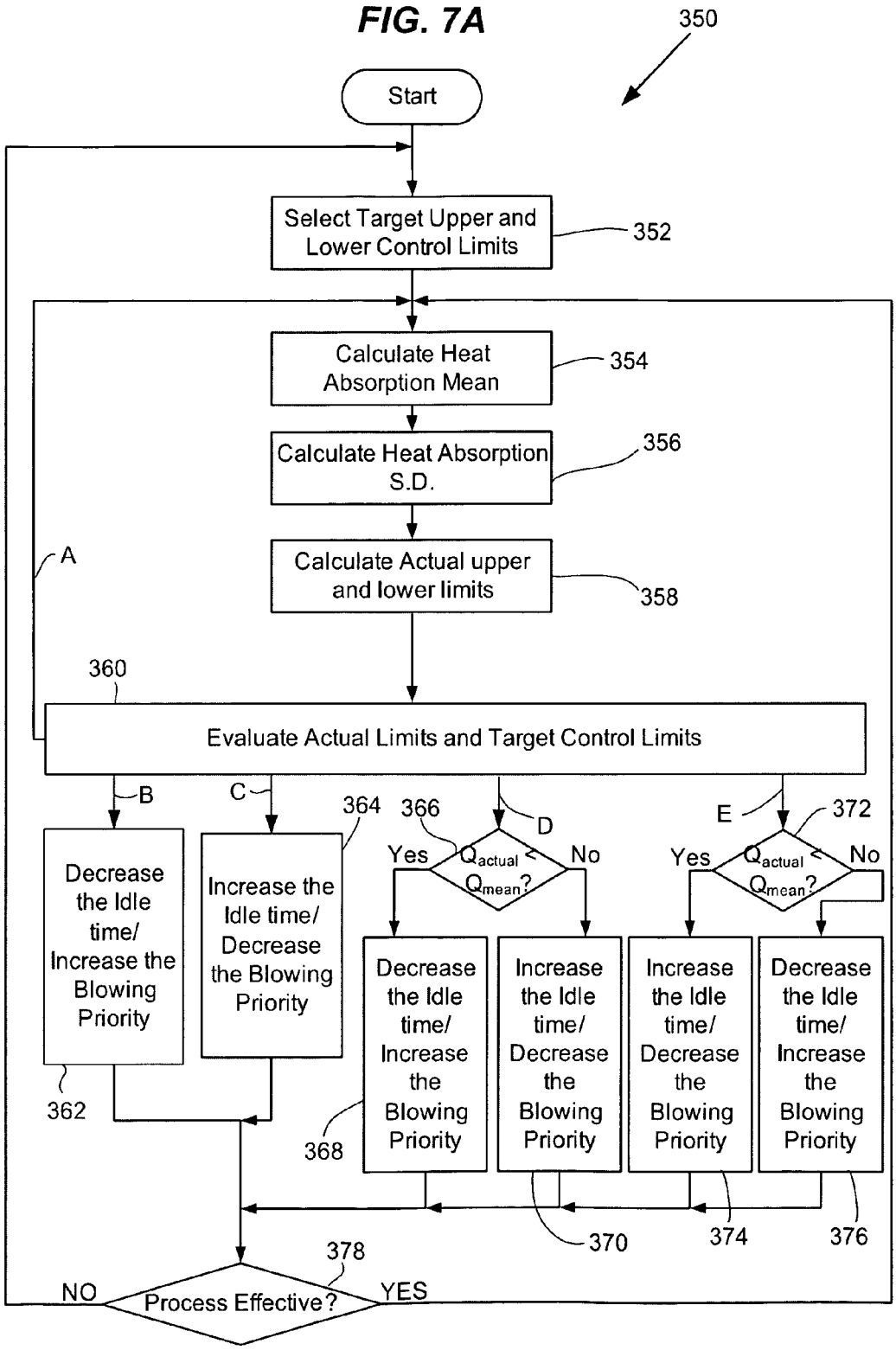
FIG. 7A illustrates a flowchart of a soot blowing statistical process control program.

FIG. 7A illustrates a flowchart of an implementation of a statistical process control program 350 that may perform the functions of the blocks 312-316. A block 352 may determine characteristics of a desired distribution of the heat absorption values for a particular heat exchange section. Determining such characteristics may include selecting a target lower control limit QLCL, a target upper control limit QUCL, and other characteristics of the desired distribution for that particular heat exchange section. The target limits and other characteristics of the desired distribution may be derived from the achievable performance information provided by the routine 20. The limits and other characteristics may be set automatically by logic programmed into the statistical process control program 350 or other operational monitoring systems, or may be set by an operator after consideration of the achievable performance information. Subsequently, a block 354 may calculate a heat absorption mean Qmean using the following equation:

$$Q_{mean} = \frac{1}{N}\sum_{i=1}^{N} Q_i$$

where N represents the number of heat absorption observations included in a given sample and Qi is the value of heat absorption for the ith observation. A block 356 may calculate a heat absorption standard deviation Qσ using the following equation:

$$Q_{\sigma} = \left[\frac{1}{N}\sum_{i=1}^{N}(Q_i - Q_{mean})^2\right]^{1/2}$$

Subsequently, a block 358 may determine an actual lower limit Qm−3σ and an actual upper limit Qm+3σ on a curve depicting a distribution of various heat absorption values. While in the present implementation of the statistical process control program 350, the actual lower limit Qm−3σ and the actual upper limit Qm+3σ are functions of only the heat absorption mean Qmean and the heat absorption standard deviation Qσ, in an alternate implementation, alternate statistical values, such as variance, may be used to calculate an alternate actual lower limit and an alternate actual upper limit. Moreover, while in the present example, the actual lower limit Qm−3σ and the actual upper limit Qm+3σ are determined to be at 3-sigma points (3σ) away from the heat absorption mean Qmean, in practice, an alternate actual lower limit of Qm−xσ and an alternate actual upper limit of Qm+xσ, located at x-sigma points (wherein x is a number that may be selected by the user of the statistical process control program 350) away from the heat absorption mean Qmean may also be used. A particular value of x used for the soot blower or other device or process may be determined based on the particular device or process and on the characteristics of the performance parameter being monitored within the device or process. A smaller value of x may be appropriate where it is desired or necessary to tightly control the device or process and to maintain a narrow distribution of the parameter, whereas a larger value of x may be appropriate for parameters where tight control of the performance parameter is not essential for the device or process to operate at or close to the achievable performance level. If desired, x may be an integer or may be any real number.

Subsequently, a block 360 compares the actual lower limit Qm−3σ with a target lower control limit QLCL and the actual upper limit Qm+3σ with the target upper control limit QUCL. The block 360 may be provided with a series of rules that may be used for performing the comparison based on the result of the comparison, the block 360 may generate a decision regarding a change that needs to be made to one or more parameters of the current operational sequencing.

Evaluating the actual lower limit Qm−3σ and the actual upper limit Qm+3σ for a particular heat exchange section provides information regarding actual distribution of the heat absorption values for that particular heat exchange section. By comparing the actual lower limit Qm−3σ with a target lower control limit QLCL and the actual upper limit Q m+3σ with the target upper control limit QUCL, the block 360 of the statistical process control program 350 determines whether the actual distribution of the heat absorption values, as measured over a particular period of time, is approximately equal to the desired distribution of the heat absorption values or not.

If the block 360 determines that the actual lower limit Qm−3σ is approximately equal to the target lower control limit QLCL and that the actual upper limit Q m+3σ is approximately equal to the target upper control limit QUCL, the actual distribution of the heat absorption values is approximately equal to the desired distribution of the heat absorption values. In this case, the block 360 may decide that the current operational sequencing used to operate the soot blowers is functioning properly, or that desired control of the soot blowing operations is successfully achieved. Therefore, no change is necessary to any operating parameters of the current operational sequencing, and control passes back to the block 354, as shown by the path A in FIG. 7A.

In some situations, the block 360 may determine that the target lower control limit is greater than the actual lower limit (QLCL>Qm−3σ) and that the target upper control limit is also greater than the actual upper control limit (QUCL>Qm+3σ). This outcome (path B in FIG. 7A) signifies that the actual distribution of the heat absorption observations is situated to the left of the desired distribution, as illustrated by a distribution 380 in FIG. 7B. In this situation, a block 362 (which may be implemented by the block 316 of FIG. 6) may decrease the idle time between successive soot blowing operations in the current operational sequencing or increase the soot blowing priority of the heat exchange section, so as to shift the actual distribution of heat absorption observations to the right. The lower idle time or the higher blowing priority results in more frequent soot blowing operations and therefore removal of higher amounts of soot deposits, which results in narrowing the distribution of the heat absorption data to a desired level specified by the target lower control limit QLCL and the target upper control limit QUCL. The amount of change in the idle time and the blowing priority may be determined empirically by a user of the boiler 100.

In another situation, the block 360 may determine that the target lower control limit is lower than the actual lower limit (QLCL<Qm−3σ) and that the target upper control limit is also lower than the actual upper control limit (QUCL<Qm+3σ). This outcome (path C in FIG. 7A) signifies that the distribution of the heat absorption observations is situated to the right of the desired distribution, as illustrated by a distribution 382 in FIG. 7B. Generally, this situation may signify excessive soot blowing. In this situation, a block 364 may increase the idle time between successive soot blowing operations in the current operational sequencing, or decrease the soot blowing priority of the heat exchange section, so as to shift the actual distribution of heat absorption observations to the left. The higher idle time or the lower blowing priority results in less frequent soot blowing operations and therefore removal of lesser amounts of soot deposits, which results in broadening the distribution of the heat absorption data to a desired level specified by the target lower control limit QLCL and the target upper control limit QUCL. The amount of change in the idle time and the blowing priority may be determined empirically by a user of the boiler 100.

Alternatively, the block 360 may determine that the target lower control limit is higher than the actual lower limit (QLCL>Qm−3σ) and that the target upper control limit is lower than the actual upper control limit (QUCL<Qm+3σ). This outcome (outcome D in FIG. 7A) signifies that the actual distribution of the heat absorption observations is broader than the desired distribution, as illustrated by a distribution 384 in FIG. 7B. In this situation, a block 366 compares the current actual heat absorption Qactual with the mean heat absorption Qmean. If the block 366 determines that Qactual<Qmean, then a block 368 decreases the idle time between successive soot blowing operations or increases the soot blowing priority of the heat exchange section. The lower idle time or the higher blowing priority results in more frequent soot blowing operations and therefore removal of higher amounts of soot deposits, which results in shifting the actual lower control limit Qm−3σ towards the desired lower control limit QLCL. The amount of change in the idle time and the blowing priority may be determined empirically by a user of the boiler 100.

On the other hand, if the block 366 determines that Qactual>Qmean, then a block 370 increases the idle time between successive blowing operations or decreases the soot blowing priority of the heat exchange section. The higher idle time or the lower blowing priority results in less frequent soot blowing operations and therefore removal of lesser amounts of soot deposits, which results in shifting the actual upper control limit Qm+3σ towards the desired upper control limit QUCL. The amount of change in the idle time and the blowing priority may be determined empirically by a user of the boiler 100.

Still further, the block 360 may determine that the target lower control limit is lower than the actual lower limit (QLCL<Qm−3σ) and that the target upper control limit is greater than the actual upper control limit (QUCL>Qm+3σ). This outcome (path E in FIG. 7A) signifies that the actual distribution of the heat absorption observations is narrower than the desired distribution, as illustrated by a distribution 386 in FIG. 7B. In this situation, a block 372 compares the current actual heat absorption Qactual with the mean heat absorption Qmean. If the block 372 determines that Qactual<Qmean, then a block 374 increases the idle time between successive blowing operations or decreases the soot blowing priority of the heat exchange section. The higher idle time or the lower blowing priority results in less frequent soot blowing operations and therefore removal of lesser amounts of soot deposits, which results in shifting the actual upper control limit Qm+3σ towards the desired upper control limit QUCL. The amount of change in the idle time and the blowing priority may be determined empirically by a user of the boiler 100.

On the other hand, if the block 372 determines that Qactual>Qmean, then a block 376 decreases the idle time between successive blowing operations or increases the soot blowing priority of the heat exchange section. The lower idle time or the higher blowing priority results in more frequent soot blowing operations and therefore removal of higher amounts of soot deposits, which results in shifting the actual lower control limit Qm−3σ towards the desired lower control limit QLCL. The amount of change in the idle time and the blowing priority may be determined empirically by a user of the boiler 100.

Subsequently, a block 378 evaluates the effectiveness of the process undertaken by the blocks 354-376 to determine if the current selection of the target upper control limit QUCL and the target lower control level QLCL are effective in controlling the operations of the soot blowers for the particular heat exchange section. The block 378 may collect various statistical data related to the shifting of the distribution curves 380-386 over several cycles of operation of the blocks 354-376. If the block 378 determines at the end of such several cycles that the distribution curves 380-386 have shifted significantly to a newer position, such as, for example, a position signified by the distribution curve 384 (of FIG. 7B), the block 378 may decide that the process undertaken by the blocks 354-376 is not effective in preventing slagging in the heat exchange section, and therefore, pass control back to the block 352 and ask the user of the statistical process control program 350 to select new values for the target upper control limit QUCL and the target lower control limit QLCL.

A broad distribution of the heat absorption values as illustrated by the curve 384 may signify that while the average heat transfer efficiency of the heat exchange section has not changed over time, individual observations of the heat transfer efficiency are more likely to vary from the average heat transfer efficiency. On the other hand, a narrow distribution of the heat absorption values as illustrated by the curve 386 may signify that while the average heat transfer efficiency of the heat exchange section has not changed over time, individual observations of the heat transfer efficiency are less likely to vary from the average heat transfer efficiency.

The shifting of the distribution of the heat absorption values to the left, as illustrated by the distribution curve 380 may signify an overall reduction in heat transfer efficiency of the heat exchange section due to higher amount of soot deposits (slagging) in the heat exchange section. On the other hand, the shifting of the distribution of the heat absorption values to the right, as illustrated by the distribution curve 382 may signify an overall increase in heat transfer efficiency of the heat exchange section. Such increased efficiency may be a result of the higher rate of soot-blowing than necessary and may damage to various water and steam carrying tubes in the heat exchange section.

Figure 7B:
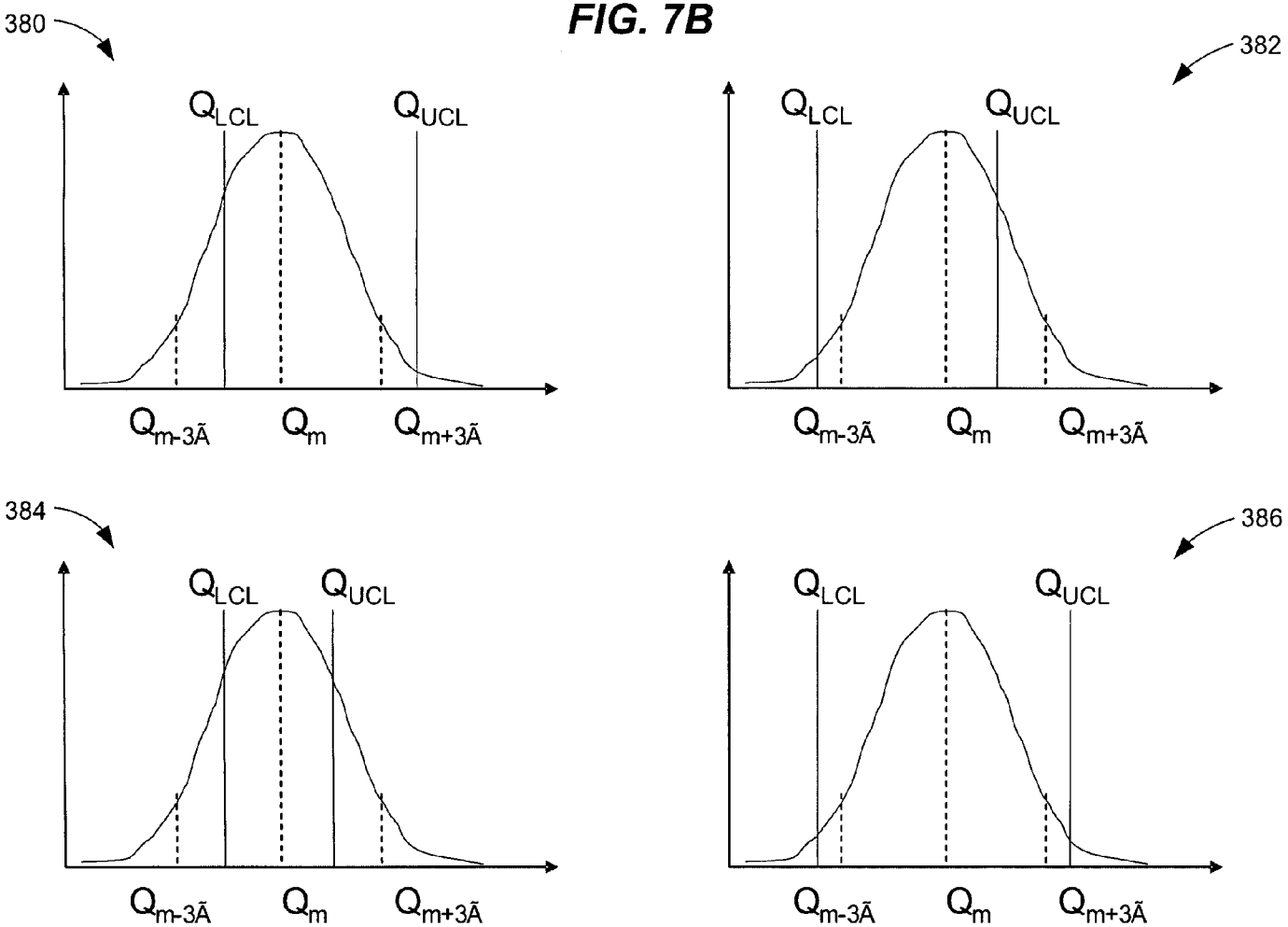
FIG. 7B illustrates a plurality of heat absorption data distribution curves.
Figure 8:
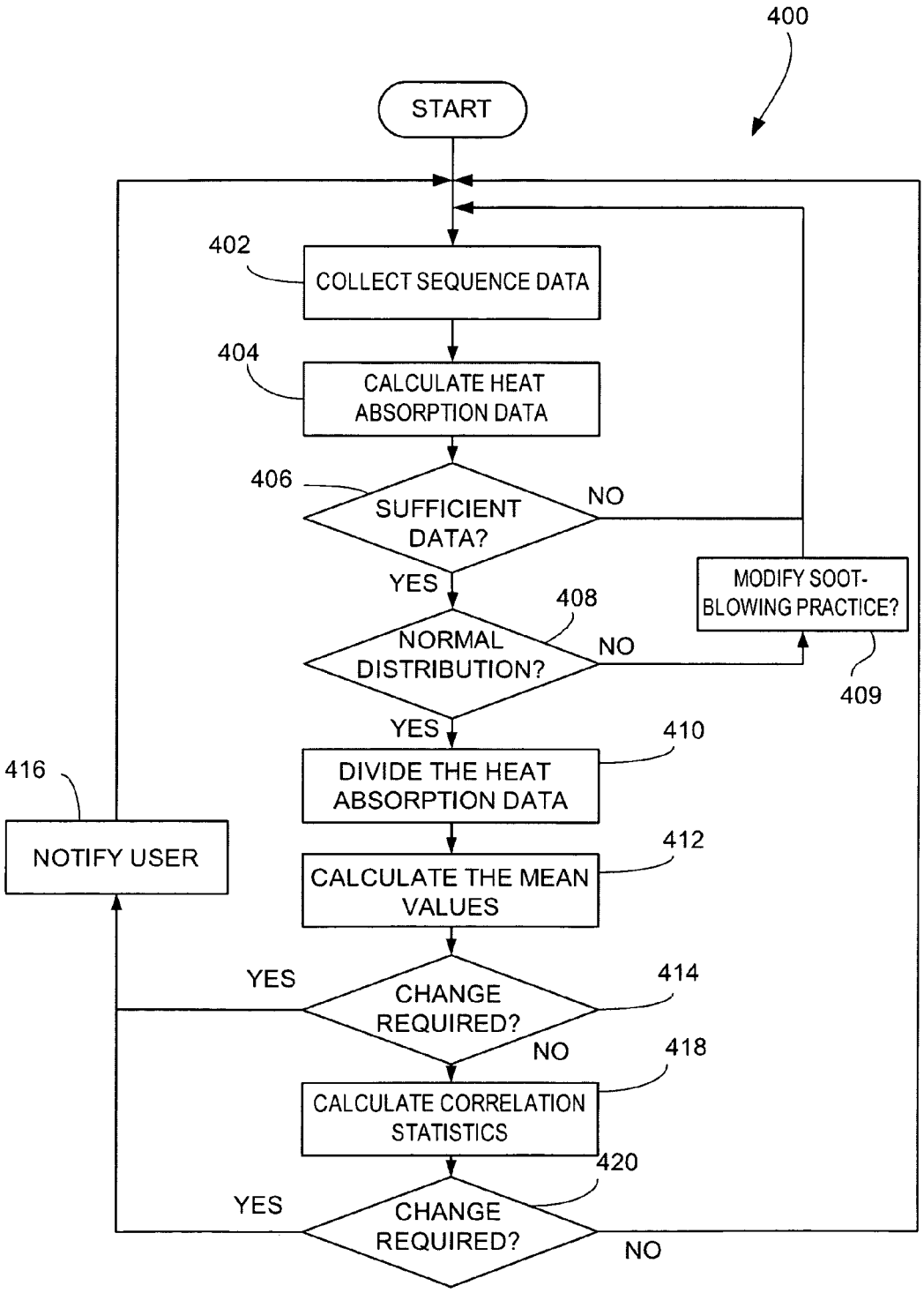
FIG. 8 illustrates a flowchart of a permanent slagging detection program.

While FIGS. 7A-7B illustrate one implementation of the statistical process control program 350, FIG. 8 illustrates another statistical process control program that can be used to determine permanent slagging within a heat exchange section of the boiler 100. Specifically, FIG. 8 illustrates a slagging detection program 400 that evaluates the distribution data of the changes in the heat absorption resulting from soot blowing and the correlation between a heat absorption change mean ΔQmean and a frequency of soot blowing in a particular heat exchange section to determine any permanent slagging in that particular heat exchange section.

Figure 9:
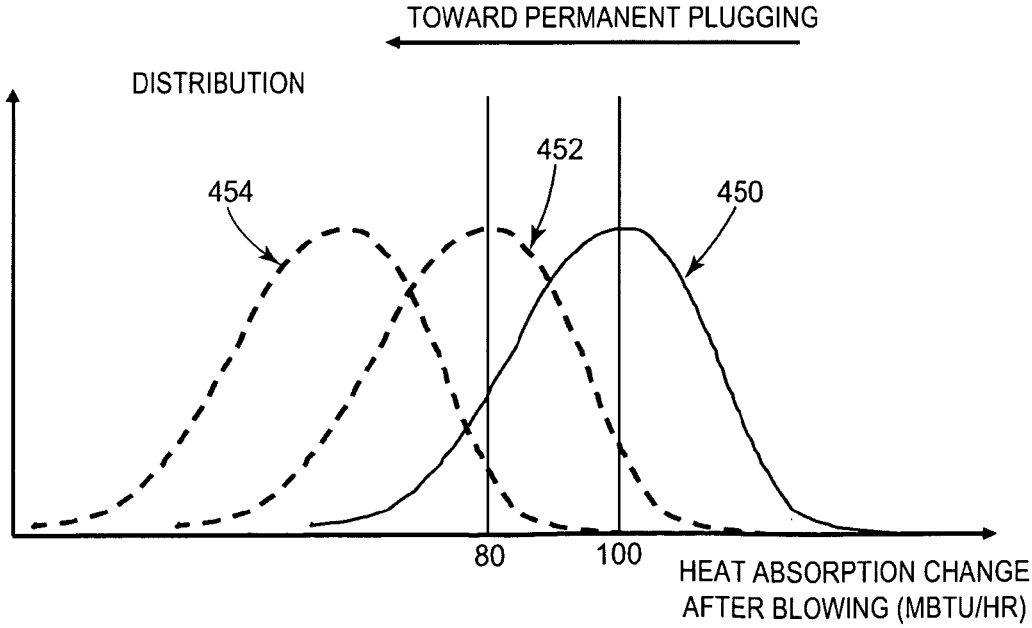
FIG. 9 illustrates a plurality of heat absorption distribution curves illustrating permanent slagging.

This situation is further illustrated by a series of distribution curves 450-454 in FIG. 9, wherein each of the curves 450-454 represents a distribution of heat absorption change values ΔQ for a particular heat exchange section over a particular period of time, wherein ΔQ may be defined as:

$$\Delta Q = Q_{after\text{-}sootblowing} - Q_{before\text{-}sootblowing}$$

For example, the curve 450 may represent a desired distribution of heat absorption change values for that particular heat exchange section. In an ideal case, the heat absorption change mean ΔQmean may have a value of approximately 100, as illustrated in FIG. 8. However, due to permanent slagging (i.e., the soot blowing not being effective any more), the curve 450 may have shifted to a position represented by the curve 452, wherein the actual absorption change mean ΔQmean may become approximately equal to only 80 or even less. The slagging detection program 400 may be used to determine such slagging in a heat exchange section.

The operation of the blocks 402-409 of the slagging detection program 400 are similar to that of the blocks 302-309 of the heat absorption statistics calculation program 300, except that while the blocks 302-309 calculate various statistics regarding heat absorption Q for a particular heat exchange section, the blocks 402-409 calculate various statistics regarding changes in the heat absorption ΔQ for a particular heat exchange section. Subsequently, a block 410 divides the heat absorption data into various temporal sections. For example, if the slagging detection program 400 has heat absorption data associated with, for example, one month of operations of the heat exchange section, the block 410 may temporally divide such heat absorption data into various sets of data. Alternatively, the block 410 may store the last certain number of periods of data on a rolling basis, such that only the last month's data are analyzed and any data from the prior periods are discarded.

A block 412 calculates the mean values for the various groups of data as provided by the block 410. For example, the block 412 may calculate the mean absorption change values for each day of the previous month. Subsequently, a block 414 analyzes these mean values to determine if there is a trend in this data. Specifically, the block 414 determines if the mean values are showing any gradual decline or increase over time. A gradual decline in mean values may indicate that the heat exchange section is trending towards permanent slagging and that a change is necessary in the current soot blowing practice. If a shift in the mean absorption change is detected, a correlation analysis may be performed.

A block 418 calculates and evaluates the correlation between the heat absorption change mean ΔQmean for a particular heat exchange section and the frequency of soot blowing in that particular heat exchange section, denoted by Corrm,f. A block 420 may determine whether the correlation value Corrm,f is higher than a given threshold value at a certain confidence level. If the correlation value Corrm,f is higher than the given threshold value, signifying a shifting of the heat absorption change mean ΔQmean to the left being significantly related to the frequency of soot blowing, the block 420 may transfer control back to the block 402 to continue operation of the slagging detection program 400 in its normal mode. However, if the block 418 determines that the correlation is not higher than the threshold value, the block 420 notifies the user that there is a potentially permanent slagging condition in the heat exchange section being evaluated. Note that while the above implementation of the slagging detection program 400 uses the correlation between the heat absorption change mean ΔQmean and the frequency of soot blowing, in an alternate implementation, correlation between the heat absorption change mean ΔQmean and the length of time for which the soot blowers are kept on during each sequence, or some other parameter of the current operational sequencing, may also be used.

Although the forgoing text sets forth a detailed description of numerous different embodiments of the invention, it should be understood that the scope of the invention is defined by the words of the claims set forth at the end of this patent. The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent, which would still fall within the scope of the claims defining the invention.

Thus, many modifications and variations may be made in the techniques and structures described and illustrated herein without departing from the spirit and scope of the present invention. Accordingly, it should be understood that the methods and apparatus described herein are illustrative only and are not limiting upon the scope of the invention.

What is claimed is:

1. A method of controlling a thermodynamic process, the method comprising:

operating the process according to a first operational state for a first period of time;

determining performance parameter values of the process during the first period of time;

determining a performance parameter statistical value from the performance parameter values; and evaluating the performance parameter statistical value against one or more target values to determine whether a change in an operating parameter of the first operational state is necessary to improve performance of the thermodynamic process.

2. A method of claim 1, wherein operating the process further comprises operating a plurality of thermodynamic devices within the process.

3. A method of claim 1, wherein determining the performance parameter statistical value further comprises determining a plurality of performance parameter statistical values.

4. A method of claim 3, wherein determining the plurality of performance parameter statistical values includes determining at least two or more of: (1) a performance parameter mean; (2) a performance parameter standard deviation; (3) a performance parameter lower limit; and (4) a performance parameter upper limit.

5. A method of claim 1, wherein determining a performance parameter statistical value includes determining a performance parameter lower limit equal to a performance parameter mean less a multiple of a performance parameter standard deviation and determining a performance parameter upper limit equal to the performance parameter mean plus the multiple of the performance parameter standard deviation.

6. A method of claim 5, wherein evaluating the performance parameter statistical value comprises:

comparing the performance parameter upper limit with a target upper control limit; and comparing the performance parameter lower limit h a target lower control limit.

7. A method of claim 6, wherein the change in the operating parameter of the first operational state is a function of a difference between the performance parameter lower limit and the target lower control limit, or a difference between the performance parameter upper limit and the target upper control limit.

8. A method of claim 6, further comprising evaluating the effectiveness of the change in the operating parameter on the unit heat rate of the process to adjust the change in the operating parameter.

9. A method of claim 8, wherein the effectiveness of the change in the operating parameter of the first operational state is evaluated by measuring a shift in the distribution of the performance parameter values.

10. A method of claim 1, wherein determining the performance parameter statistical value includes determining a performance parameter change mean value.

11. A method of claim 1, wherein the process is one of: (1) a water wall absorption section; (2) a superheat section; (3) a reheat absorption section; (4) an economizer; or (5) an air heater.

12. A method of claim 1, further comprising analyzing a distribution of the performance parameter values to determine if the distribution of the performance parameter values conform to normal distribution.

13. A method of claim 1, wherein operating the process further comprises operating a single thermodynamic device within the process.

14. A method of claim 1, wherein evaluating the performance parameter statistical value comprises comparing the performance parameter statistical value to an achievable performance measure for the performance parameter.

15. A method of claim 14, comprising:

collecting operational data during the operation of the process during a second period of time during which the process operates at an achievable performance level for the process;

calculating values of performance parameters from the operational data collected during the second period of time;

performing statistical analysis of the operational data collected for the performance parameters during the second period of time;

deriving correction functions for the performance parameters from the operational data collected for the performance parameters during the second period of time; and determining the achievable performance measure based on the statistical analysis of the operational data and the correction functions derived from the operational data.

16. A method of claim 15, wherein the second period of time occurs at a different time than the first period of time.

17. A method of claim 15, wherein the second period of time occurs during the first period of time.

18. A method of determining an achievable performance measure for a thermodynamic process and controlling the thermodynamic process, comprising:

operating the process during an evaluation period of time in which the process operates at a maximum achievable performance level;

collecting operational data during the operation of the process during the evaluation period of time;

calculating values of performance parameters of the process from the operational data collected during the evaluation period of time;

performing statistical analysis of the operational data collected for the performance parameters during the evaluation period of time;

deriving correction functions for the performance parameters from the operational data collected for the performance parameters during the evaluation period of time;

substituting the derived correction functions for manufacturer-supplied correction curves or previously derived correction functions; and determining an achievable performance measure, the value of which most closely correlates with the maximum achievable performance level, based on the statistical analysis of the operational data and the correction functions derived from the operational data.

19. A method of claim 18, comprising providing feedback to an operational monitor regarding the achievable performance measure.

20. A method of claims 18, comprising:

operating the process according to a first operational state for an operational period of time;

determining performance parameter values of the process during the operational period of time;

determining a performance parameter statistical value from the performance parameter values; and comparing the performance parameter statistical value the achievable performance measure to determine a change in an operating parameter of the first operational state.

21. A method of claim 20, wherein the operational period of time occurs at a different time than the evaluation period of time.

22. A method of claim 20, wherein the evaluation period of time occurs during the operational period of time.

23. A method of claim 20, wherein determining the performance parameter statistical value further comprises determining a plurality of performance parameter statistical values.

24. A method of claim 20, wherein determining the plurality of performance parameter statistical values includes determining at least two or more of: (1) a performance parameter mean; (2) a performance parameter standard deviation; (3) a performance parameter lower limit; and (4) a performance parameter upper limit.

25. A method of claim 20, wherein determining a performance parameter statistical value includes determining a performance parameter lower limit equal to a performance parameter mean less a multiple of a performance parameter standard deviation and determining a performance parameter upper limit equal to the performance parameter mean plus the multiple of the performance parameter standard deviation.

26. A method of claim 25, wherein evaluating the performance parameter statistical value comprises:

comparing the performance parameter upper limit with a target upper control limit of the achievable performance measure; and comparing the performance parameter lower limit with a target lower control limit of the achievable performance measure.

27. A method of claim 26, wherein the change in the operating parameter of the first operational state is a function of a difference between the performance parameter lower limit and the target lower control limit, or a difference between the performance parameter upper limit and the target upper control limit.

28. A method of claim 20, wherein the effectiveness of the change in the operating parameter of the first operational state is evaluated by measuring a shift in the distribution of the performance parameter values.

29. A method of claim 20, further comprising analyzing a distribution of the performance parameter values to determine if the distribution of the performance parameter values conform to normal distribution.

30. A method of claim 18, wherein operating the process further comprises operating a plurality of thermodynamic devices within the process.

31. A method of claim 18, wherein operating, the process further comprises operating a single thermodynamic device within the process.

* * * * *

UNITED STATES PATENT AND TRADEMARK OFFICE

CERTIFICATE OF CORRECTION

PATENT NO. : 8,140,296 B2
APPLICATION NO. : 12/047139
DATED : March 20, 2012
INVENTOR(S) : Peter N. Francino et al.

It is certified that error appears in the above-identified patent and that said Letters Patent is hereby corrected as shown below:

In the Claims:

At Column 19, line 60, "h a" should be -- with a --.

Signed and Sealed this
First Day of October, 2013

Teresa Stanek Rea

Teresa Stanek Rea
*Deputy Director of the United States Patent and Trademark Office*